US005170506A

United States Patent [19]

Lewis, Jr. et al.

[11] Patent Number: 5,170,506

[45] **Date of Patent: * Dec. 15, 1992**

[54] VENTILATED PROTECTIVE GARMENT ADAPTED FOR REACHING OVERHEAD

[75] Inventors: Milton A. Lewis, Jr., Richmond, Va.; Jeffrey S. Mason, Covington, Ind.; Carson B. Swinford, Danville, Ill.; Timothy R. Wiseman, Sr., Richmond, Va.

[73] Assignees: E. I. Du Pont de Nemours and Company, Wilmington, Del.; Steel Grip, Inc., Danville, Ill.

[ * ] Notice: The portion of the term of this patent subsequent to Apr. 16, 2008 has been disclaimed.

[21] Appl. No.: 720,166

[22] Filed: Jun. 27, 1991

[51] Int. Cl.[5] ..... A41D 13/02

[52] U.S. Cl. ..... 2/79; 2/81; 2/DIG. 1; 2/DIG. 4

[58] Field of Search ..... 2/79, 81, DIG. 1, DIG. 4

[56] References Cited

U.S. PATENT DOCUMENTS

| | | | |
|---|---|---|---|
| 601,489 | 3/1898 | Tim | 2/115 |
| 1,169,256 | 1/1916 | Grimm et al. | 2/DIG. 4 |
| 1,363,981 | 12/1920 | Jenkins | 2/79 |
| 2,314,226 | 3/1943 | Lee | 2/DIG. 1 |
| 2,327,979 | 8/1943 | Bailey | 2/97 |
| 2,500,084 | 3/1950 | Metzger | 2/97 |
| 2,512,990 | 6/1950 | Akerman | 2/81 |
| 2,773,262 | 12/1956 | Brouha et al. | 2/81 |
| 2,941,210 | 6/1060 | Bren | 2/DIG. 4 |
| 2,994,089 | 8/1961 | Ferguson, Jr. et al. | 2/81 |
| 3,086,215 | 4/1963 | Di Paola | 2/DIG. 1 |
| 3,292,179 | 12/1966 | Iacono, Jr. et al. | 2/2 |
| 3,651,520 | 3/1972 | Jacob | 2/272 |
| 3,691,564 | 9/1972 | La Marre et al. | 2/2 |
| 3,706,102 | 12/1972 | Grenier | 2/84 |
| 3,744,534 | 7/1973 | Henry et al. | 2/81 |
| 3,793,646 | 2/1974 | Tempelhof | 2/227 |
| 4,004,297 | 1/1977 | Polack | 2/227 |
| 4,034,417 | 7/1977 | Ellis | 2/81 |
| 4,223,064 | 9/1980 | Ballif, III et al. | 2/81 |
| 4,507,806 | 4/1985 | Coombs | 2/81 |
| 4,722,099 | 2/1988 | Kratz | 2/79 |
| 4,843,646 | 7/1989 | Grilliot et al. | 2/69 |
| 4,890,336 | 1/1990 | Worton | 2/79 |
| 4,897,886 | 2/1990 | Grillot et al. | 2/81 |
| 5,007,112 | 4/1991 | Lewis, Jr. et al. | 2/79 |
| 5,014,357 | 5/1991 | Wiseman, Sr. | 2/81 |
| 5,020,161 | 6/1991 | Lewis, Jr. et al. | 2/164 |
| 5,048,124 | 9/1991 | Lewis, Jr. et al. . | |
| 5,050,241 | 9/1991 | Flowers et al. . | |

FOREIGN PATENT DOCUMENTS

| | | | |
|---|---|---|---|
| 253387 | 1/1963 | Australia | 2/DIG. 4 |
| 1166636 | 6/1958 | France | 2/DIG. 1 |
| 1399632 | 4/1965 | France | 2/97 |
| 2447157 | 1/1979 | France . | |
| 1240203 | 7/1971 | United Kingdom | 2/272 |
| 1491947 | 11/1977 | United Kingdom | 2/DIG. 1 |

*Primary Examiner*—Werner H. Schroeder
*Assistant Examiner*—Gloria Hale

[57] ABSTRACT

A one-piece protective garment of the type affording barrier and thermal protection against hot and/or corrosive liquids. The garment includes a generally continuous outer shell of woven aramid fabric covered by a liquid impervious layer and a corresponding inner multilayer thermally insulating liner inside of the outer shell. The inner liner is fabricated from at least one layer of low density nonwoven fabric fastened to a woven fabric. An elongated leg inseam opening is provided on the underside of the torso portion of the liner fabric and which extends from the position of the wearer's crotch downwardly into and along the inside of each leg. The garment also has an underarm inseam opening under and partially around each arm of the liner extending upwardly from the position of the wearer's armpit along the front and back seam between the sleeve and the torso portion of the inner liner. A stretchable, air permeable fabric is attached to the liner fabric and covers and defines the size and shape of the respective openings. The protective garment in accordance with the invention provides ventilation and greater freedom of movement in reaching overhead, without substantially decreasing the protection provided by the garment.

6 Claims, 5 Drawing Sheets

VENTILATED PROTECTIVE GARMENT ADAPTED FOR REACHING OVERHEAD

FIELD OF THE INVENTION

The present invention relates to a ventilated protective garment allowing increased mobility to the wearer. In particular, the invention relates to a ventilated protective garment providing protection to the wearer against hot and/or corrosive chemicals which has been adapted for allowing the wearer to reach overhead.

BACKGROUND OF THE INVENTION

Various types of protective coveralls are known for use in protecting the wearer of the coveralls from hazards including hot and/or corrosive chemicals, flame, molten metals, steam and the like. One such type of coveralls used for protection against hot and/or corrosive chemicals includes a one-piece suit for the body, arms and legs and a separate, removable headgear worn together with the one-piece suit. Protective gloves which are capable of providing generally the same protection as the suit are typically worn with the suit.

Coveralls of this type, which have been found to be particularly effective in providing protection, have a laminated construction with a generally continuous outer shell of woven aramid fabric covered by a liquid impervious layer which is a barrier to the liquids to be encountered. The coveralls also include an inner liner which increases protection against high temperature conditions and which may also include additional barrier layers. A particularly effective type of liner has been found to be a multilayer thermally insulating liner fabricated from at least one layer of low density nonwoven fabric fastened to a woven fabric.

In such coveralls, it typically is difficult to provide necessary ventilation and mobility without adversely affecting protection afforded by the liquid impervious barrier layer in the coveralls. Consequently, a cooling air system which uses air supplied from a source of pressurized air is provided in the interior of the coveralls. However, even with a cooling air system, adequate air circulation is difficult to achieve and it is particularly difficult to ventilate the armpit and crotch areas. Although a general solution to the ventilation problem is disclosed in U.S. Pat. No. 5,007,112 (Lewis, Jr. et al.), it is also important that the wearer be able to reach overhead while wearing the ventilated coveralls.

Clearly, what is needed is a protective garment that does not have the problems and deficiencies inherent in the prior art. To this end, the applicants have discovered a solution to the aforementioned mobility problem wherein ventilated openings under the wearer's armpit are adapted to allow the wearer to reach overhead. Other objects and advantages of the invention will become apparent to those skilled in the art upon reference to the drawings and the detailed description of the invention which hereinafter follow.

SUMMARY OF THE INVENTION

The invention provides a protective garment of the type affording barrier and thermal protection against hot and/or corrosive liquids. The garment includes a generally continuous outer shell of woven aramid fabric covered by a liquid impervious layer and a corresponding inner multilayer thermally insulating liner inside of the outer shell. The inner liner is fabricated from at least one layer of low density nonwoven fabric fastened to a woven fabric. An elongate leg inseam opening is provided on the underside of the torso portion of the liner fabric and extends from the position of the wearer's crotch downwardly into and along the inside of each leg. A stretchable, air permeable fabric is attached to the liner fabric and covers and defines the size and shape of the leg inseam opening. The garment also has an underarm inseam opening under and partially around each arm of the liner extending upwardly from the position of the wearer's armpit along the front and back seam between the sleeve and the torso portion of the inner liner. A stretchable, air permeable fabric is attached to the liner fabric and covers and defines the size and shape of the underarm inseam openings. The garment in accordance with the invention provides ventilation and greater freedom of movement in reaching overhead, without substantially decreasing the protection provided by the garment.

BRIEF DESCRIPTION OF THE DRAWINGS

The invention and its advantages may be understood by those skilled in the art by reference to the following detailed description when read in conjunction with the accompanying drawings in which.

DETAILED DESCRIPTION OF THE PREFERRED EMBODIMENTS

Figure 1:
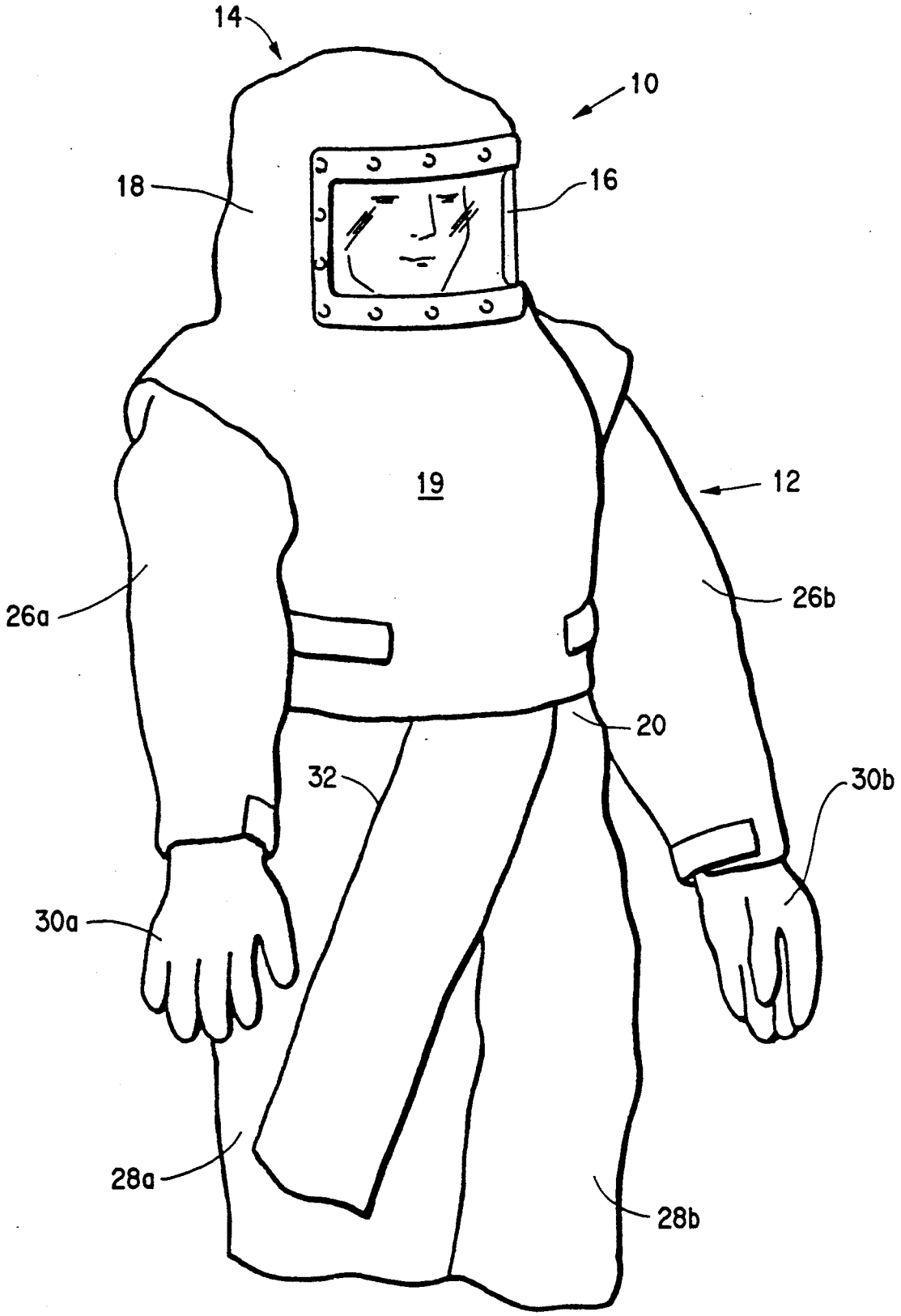
FIG. 1 is a diagrammatical perspective view of a preferred embodiment of protective garment in accordance with the present invention.

Referring now to the drawings in which like reference characters designate like and corresponding parts throughout the several views, there is shown in FIG. 1 protective coveralls 10 embodying a preferred form of the present invention. The protective coveralls include a one-piece main suit 12 and removable headgear 14. The headgear 14 includes a viewing lens 16, a downwardly-draping hood 18 for covering the head of the wearer of the coveralls 10 and a hood bib 19 covering. the upper areas of the main suit 12.

The coveralls 10 depicted are intended to represent coveralls which have a laminated construction intended to provide protection against hot and/or corrosive chemicals. The coveralls 10 include an outer shell fabric of woven aramid fabric covered by a liquid impervious layer and an inner multilayer thermally insulating liner fabric of at least one layer of low density nonwoven fabric fastened to a woven fabric. While not specifically intended for such purposes, coveralls of this type can offer protection against steam jets from a source with a pressure of less than about 150 psi. The outer shell-inner liner laminated construction is generally employed for most portions of the coveralls although the unlined shell may comprise portions of the suit which are not in direct contact with the body, such as the hood bib 19. A preferred shell is constructed from a fabric woven from poly(paraphenylene terephthalamide) fiber which has been laminated to a liquid impervious layer, preferably, an aluminum film-poly(ethylene terephthalate) film laminate. A preferred multilayer liner includes at least a layer of woven poly(metaphenylene isophthalamide) and a nonwoven layer, such as one or more layers of spunlaced fabrics of poly(paraphenylene terephthalamide). The layers are fastened together by suitable means such as by quilting. The preferred shell and multilayer liner are disclosed in more detail in U.S. Pat. No. 5,014,357 (Wiseman, Sr.), the entire contents of which are incorporated herein.

Figure 2:
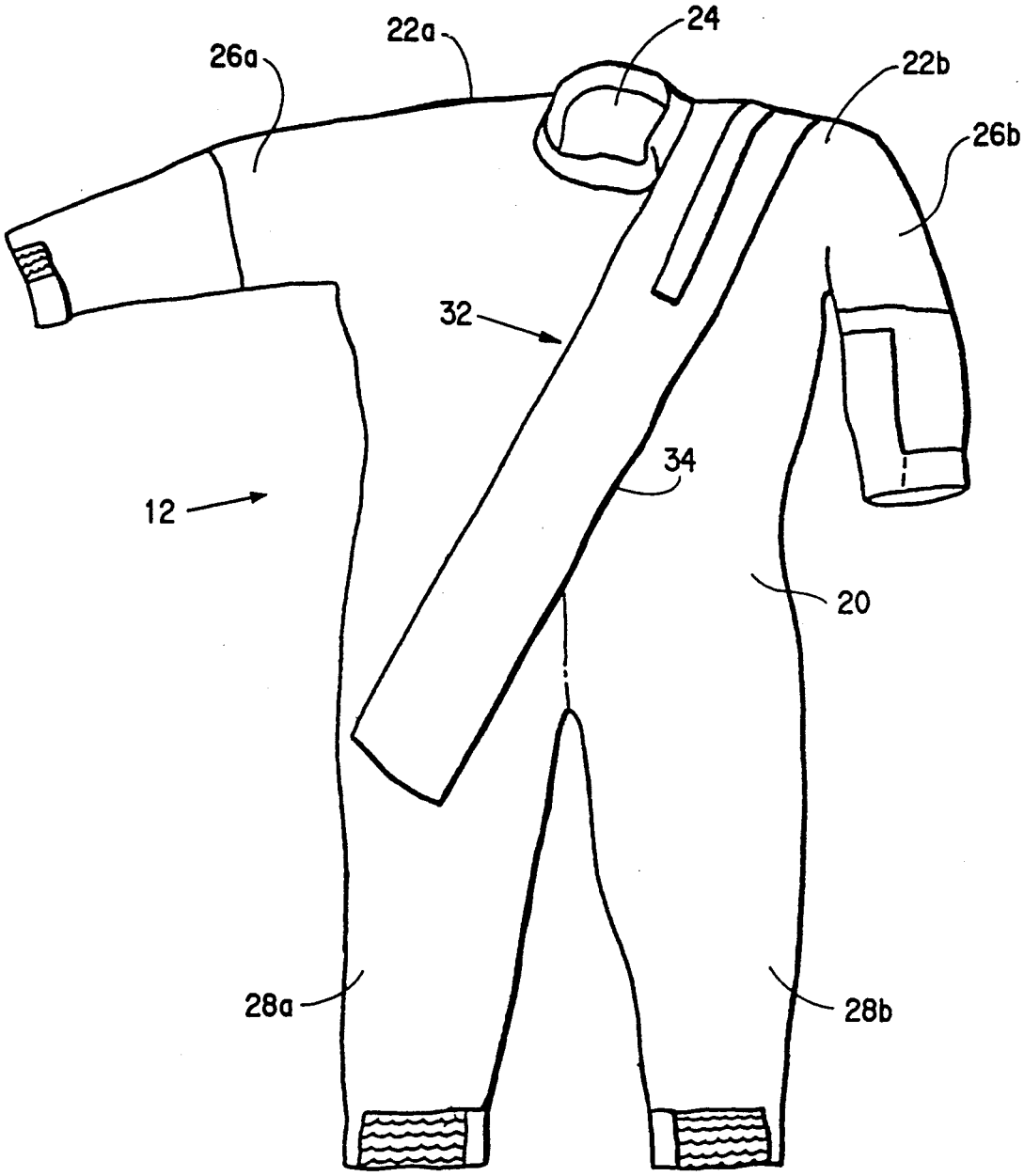
FIG. 2 is a diagrammatical perspective view of a main suit forming a portion of the garment illustrated in FIG. 1.

Referring to FIGS. 1 and 2, the main suit 12 of the coveralls 10 includes a torso portion 20 including right and left shoulder areas, 22*a* and 22*b*, respectively, and a neck opening 24. Right and left arm and leg portions, 26*a* and 26*b*, respectively and 28*a* and 28*b*, respectively, are connected to the one piece main suit. Right and left gloves, 30*a* and 30*b*, respectively, constructed of the same materials as the main suit 12 are also provided.

Referring still to FIGS. 1 and 2, a main closure 32 is provided in the main suit 12 for providing easy access into the suit. The main closure 32 includes a slit-like opening (not shown) which, in the suit depicted, extends downwardly from the neck opening 24 adjacent the uppermost area of the left shoulder area 22*b* and which extends diagonally across the front of the torso portion 20 to a position adjacent the upper area opposite leg portion which is the right leg portion 28*a*. The slit-like opening is closable by a zipper (not shown) and is covered by an elongate flap 34. The elongate flap 34 is attached to the main suit 12 along and adjacent to the zipper at one side of the opening with the flap 34 to cover the zipper and provide an overlapping portion which overlaps the suit on the opposite side of the opening. The elongate flap 34 is made out of the same fabric as the main suit 12 and thus provides protection and prevents the entry of hazardous materials through the closure 32. The elongate flap 34 is permanently attached on one side of the opening, such as by sewing, but is removable from the opposite side since it is secured by means of complementary hook and loop fastening tapes, such as those sold under the trademark VELCRO®.

Figure 3:
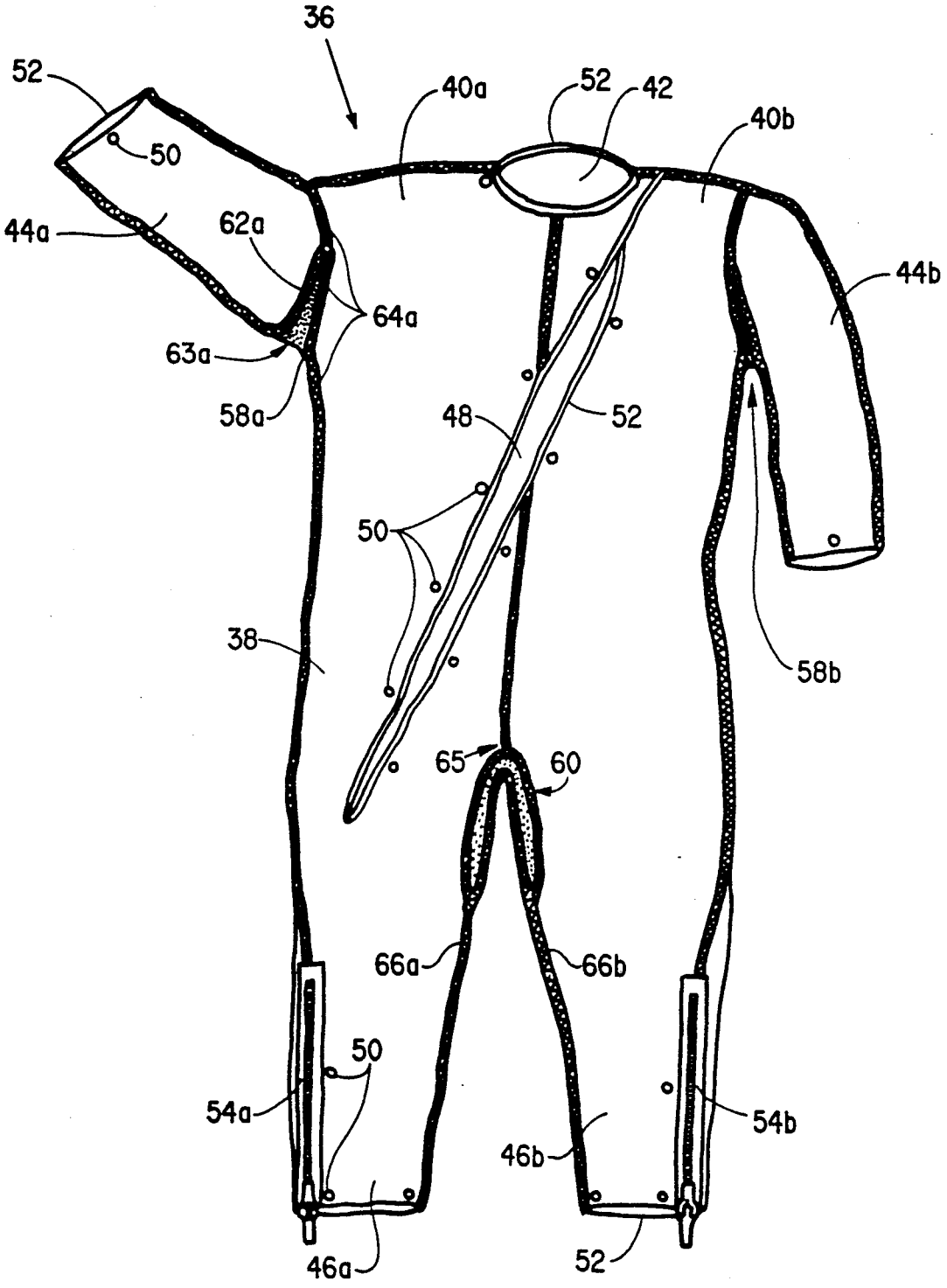
FIG. 3 is a diagrammatical perspective view of inner liner of the garment illustrated in FIG. 1.

Referring now to FIG. 3, a preferred inner liner 36 for the main suit 12 in accordance with the present invention is shown. The inner liner 36 is fabricated from appropriately cut pieces of the multilayer laminated fabric suitably secured together such as by double-stitching with the seams to the exterior as indicated. The inner liner 36 has portions which correspond to the outer shell including a torso portion. 38 and right and left shoulder areas, 40*a* and 40*b*, respectively, and a neck opening 42. Right and left sleeve and leg portions, 44*a* and 44*b*, respectively and 46*a* and 46*b*, respectively, further make up the inner liner 36. A slit-like opening 48 is provided in the front of the torso portion 38 which corresponds to the opening for the main closure 32. In the preferred embodiment illustrated, the liner 36 is secured by snaps 50 to the outer shell and is therefore removable from the outer shell such as for cleaning. Binding 52 is used at the neck opening 42, end of the sleeves and legs, and at the slit-like opening 48 to neatly secure the multiple layers of the liner fabric where no seam is otherwise present. Right and left zippers 54*a* and 54*b*, respectively, are provided at the lower areas of the legs to facilitate access into the coveralls in use.

In accordance with the invention, the inner liner 36 is provided with right and left underarm gussets 58*a* and 58*b*, respectively, which provide for ventilation and improved mobility, especially when reaching overhead. Leg inseam gusset 60 provides additional ventilation in the coveralls and provides additional comfort as will be explained in more detail hereinafter. Each of the gussets is formed by an inseam opening which is covered with a stretchable, air permeable fabric which is attached to the periphery of the opening such as by sewing. A preferred stretchable, air permeable fabric is commercially-available stretchable nylon mesh, such as that typically used for the manufacture of football jerseys. While the stretchable, air permeable fabric defines the size and shape of the opening, the shape of the openings is somewhat variable due to stretching of fabric in use.

With the left underarm gusset 58*b* being understood to correspond to the following description but on the left side, the right underarm gusset 58*a* is formed in an underarm inseam opening created between the right sleeve seam 62*a* and the right torso portion seam 64*a*. Gusset 58*a* extends under the area of the wearer's armpit 63*a* and upwardly along about one-half of the lower circumference of the circle created between the attachment point of the right sleeve 44*a* and the torso portion 38. The underarm inseam opening created under and around armpit 63*a* extends upwardly along the front and back sides of the inner liner from the position of the wearer's armpit 63*a* along seam 62*a* of the right sleeve and along seam 64*a* of the torso portion 38. Preferably, each of the underarm gussets 58*a* and 58*b* has a combined length, under and around its respective armpit area, of between about 12 and about 20 inches (about 30.5 and about 51 cm) and a width of between about 1 and about 2.5 inches (2.5 and about 6.4 cm). Toward their ends, the gussets preferably taper in width so that they merge smoothly into the seams adjoining the gussets.

In the preferred embodiment depicted, the leg inseam gusset 60 is formed from an opening in the right and left inseams 66*a* and 66*b* from the position of the wearer's crotch 65. In addition, it is preferable for the stretchable, air permeable fabric of the leg inseam gusset to have a combined length along the inside of both legs of between about 12 and about 20 inches (about 30.5 and about 51 cm) and a width of between about 1 and about 2.5 inches (2.5 and about 6.4 cm). Toward its ends, the leg inseam gusset 60 preferably is tapered in width so that it merges smoothly into the inseams 66*a* and 66*b* adjoining the gusset.

Figure 4:
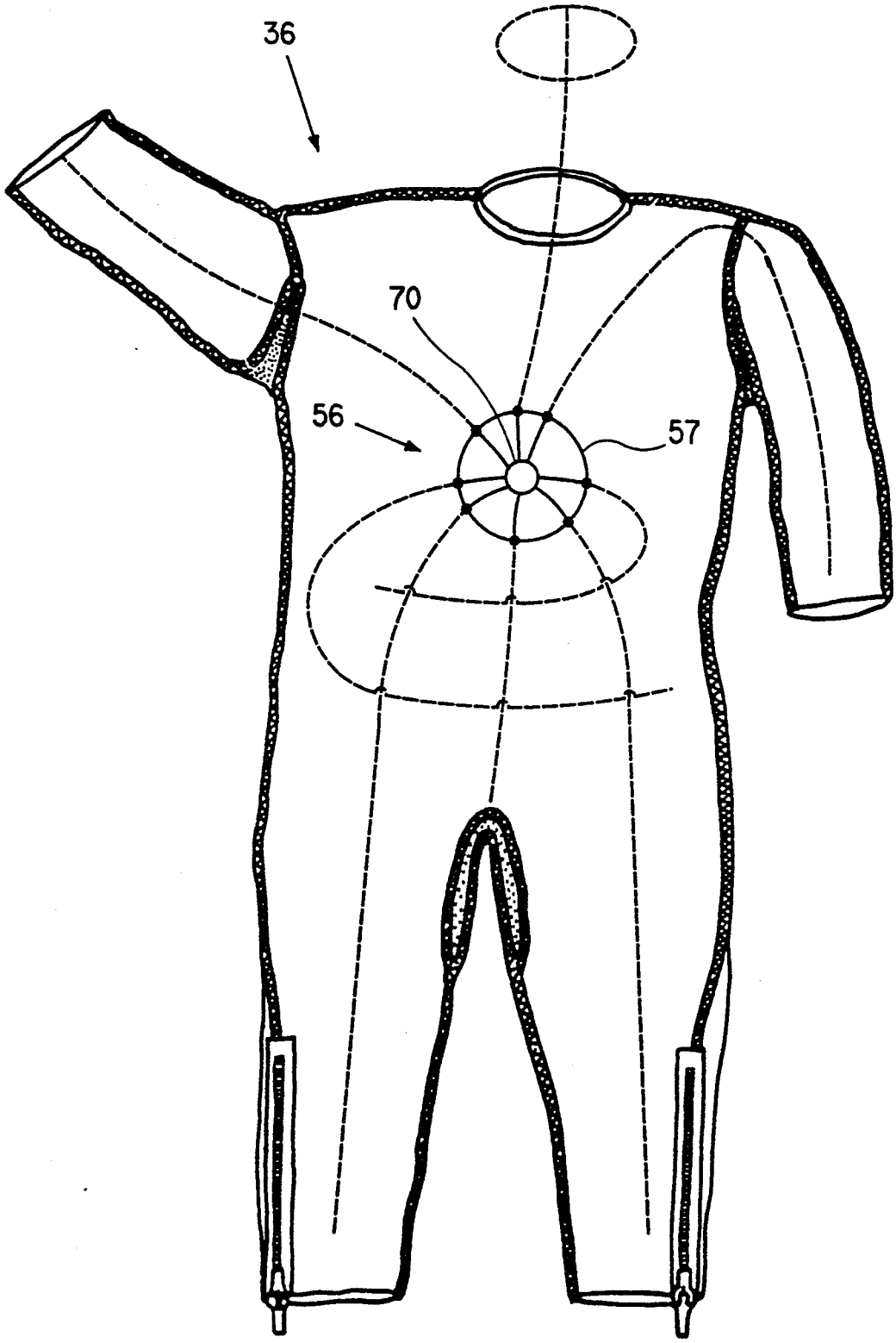
FIG. 4 is a simplified view of the inner liner of FIG. 3 illustrating a cooling air system for distributing cooling air to various portions of the inside of the inner liner.

Referring now to FIG. 4, a preferred cooling air system 56 for the coveralls is shown. The system 56 employs small diameter tubing that is connected to a distribution block 57 located in the center of the wearer's upper back. The tubing is indicated with dotted lines in FIG. 4 as it extends to the arms, head, back and legs. The tubing has a number of spaced-apart vent holes and is secured inside the liner by fasteners (not shown) and is connected to a fitting 70 which extends through the outer shell and inner liner of the coveralls. Air from a source (not shown) is used to supply the system 56, which system distributes the air to various portions on the inside of the inner liner 36.

The coveralls of the invention are used similarly to known coveralls of this type but increased ventilation, mobility and comfort results. The gussets provide a vent for air and moisture from the liner 36 which can provide for increased ventilation with the air supplied from the cooling air system 56. Supplied air is readily vented from the gussets and is then vented from the coveralls by traveling between the space between the outer shell and inner liner to existing openings in the outer shell, e.g., at the neck opening which is covered by the hood. In addition, the gussets allow for expansion of the liner to prevent binding and provide for increased comfort and mobility to the wearer. In particular, as opposed to prior art coveralls, the underarm gussets 58*a* and 58*b* of the inventive coveralls enhance arm mobility when the wearer reaches overhead above his shoulders. Because no vents are made in the outer shell and because of the protected locations of the gussets, the liquid barrier protection of the coveralls is not affected and thermal protection is not substantially decreased.

Figure 5:
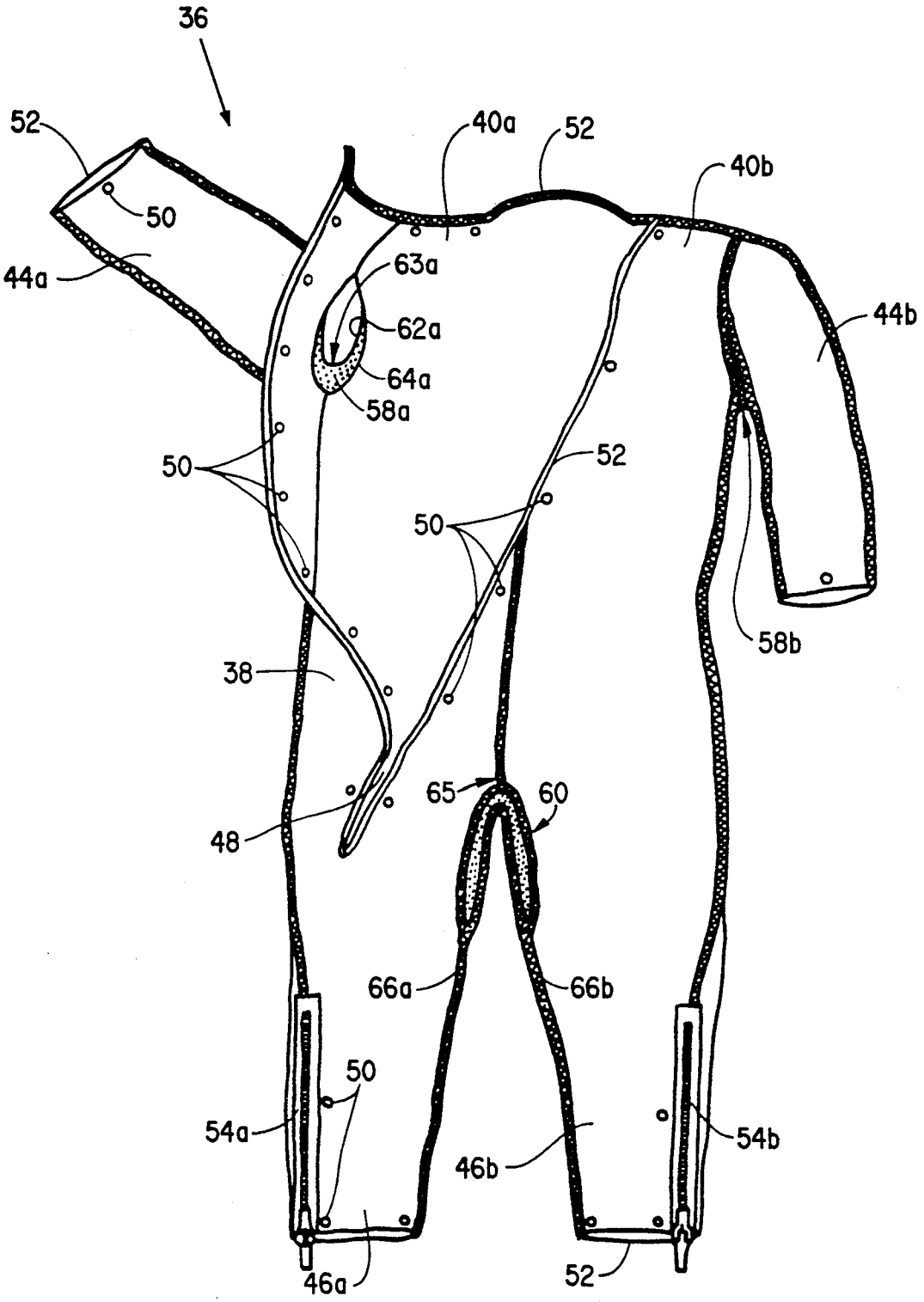
FIG. 5 is a diagrammatical perspective view of the inner liner of FIG. 3 illustrating the inside area where the right sleeve is attached to the torso portion of the inner liner.

Referring now to FIG. 5, the inner liner fabric covering the right shoulder area 40*a* is shown partially open so that it exposes the inside area of the wearer's right armpit. In particular, FIG. 5 shows the inside area where the right sleeve 44*a* is sewn to the torso portion 38. The gusset 58*a* is shown in more detail positioned under the area of the wearer's armpit 63*a* and extending upwardly in the area between seam 62*a* of the right sleeve and along seam 64*a* of the torso portion 38.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

We claim:

1. A one-piece protective garment of the type affording barrier and thermal protective against hot and/or corrosive liquids having a generally continuous outer shell of woven aramid fabric covered by a liquid impervious layer and an inner multilayer thermally insulating liner inside of the outer shell, the inner liner being fabricated from at least one layer of low density nonwoven fabric fastened to a woven fabric, the outer shell and inner liner having corresponding torso, sleeve and leg portions, wherein there is provided:

an elongate leg inseam opening in the torso portion of the liner fabric extending from the position of the wearer's crotch downwardly into and along the inside of each leg; and a stretchable, air permeable fabric attached to the liner fabric and covering and defining the size and shape of the leg inseam opening;

an underarm inseam opening under and partially around each arm of the liner extending upwardly from the position of the wearer's armpit along a front and a back seam formed between the sleeve and the torso portion of the inner liner;

a stretchable, air permeable fabric attached to the liner fabric and covering and defining the size and shape of the underarm inseam openings;

the inner liner providing ventilation and greater freedom of movement to the wearer in reaching overhead without substantially decreasing the protection provided by the garment.

2. The garment of claim 1 wherein the stretchable, air permeable fabric at each of the underarm inseam openings has a combined length under and partially around the wearer's armpits of between about 12 and about 20 inches (about 30.5 and about 51 cm) and a width of between about 1 and about 2.5 inches (2.5 and about 6.4 cm).

3. The garment of claim 1 wherein the stretchable, air permeable fabric and the leg inseam opening has a combined length along the inside of both legs of between about 12 and about 20 inches (about 30.5 and about 51 cm) and a width of between about 1 and about 2.5 inches (2.5 and about 6.4 cm).

4. The garment of claim 1 wherein the openings are formed at seams between fabric pieces assembled to form the inner liner.

5. The garment of claim 1 wherein the stretchable, air permeable fabric comprises stretchable nylon mesh.

6. The garment of claim 1 further comprising a supplied cooling air system for supplying cooling air to an area inside the inner liner.

* * * * *